US008753223B2

(12) United States Patent
Stites

(10) Patent No.: US 8,753,223 B2
(45) **Date of Patent: *Jun. 17, 2014**

(54) GOLF CLUB FACE WITH SPIN STRIP

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 461 days.

This patent is subject to a terminal disclaimer.

(21) Appl. No.: 12/983,618

(22) Filed: Jan. 3, 2011

(65) Prior Publication Data

US 2011/0136585 A1 Jun. 9, 2011

Related U.S. Application Data

(63) Continuation-in-part of application No. 12/775,718, filed on May 7, 2010, now Pat. No. 7,862,449, which is a continuation of application No. 12/259,541, filed on Oct. 28, 2008, now Pat. No. 7,713,139.

(51) Int. Cl.
*A63B 53/04* (2006.01)

(52) U.S. Cl.
USPC ..... 473/324; 473/329; 473/331; 473/332; 473/342; 473/349; 473/409

(58) Field of Classification Search
USPC ..... 473/324–350
See application file for complete search history.

(56) References Cited

U.S. PATENT DOCUMENTS

| | | | | |
|---|---|---|---|---|
| 4,792,140 | A | 12/1988 | Yamaguchi et al. | |
| 5,358,249 | A | 10/1994 | Mendralla | |
| 5,542,675 | A | 8/1996 | Micciche et al. | |
| 5,620,381 | A | 4/1997 | Spalding | |
| 5,688,186 | A | 11/1997 | Michaels et al. | |
| 5,709,617 | A | 1/1998 | Nishimura et al. | |
| 5,972,144 | A * | 10/1999 | Hsu | 156/154 |
| 6,302,807 | B1 | 10/2001 | Rohrer | |
| 6,849,004 | B2 * | 2/2005 | Lindsay | 473/330 |
| 7,278,926 | B2 | 10/2007 | Frame | |
| 7,281,990 | B2 | 10/2007 | Hagood et al. | |
| 7,713,139 | B1 * | 5/2010 | Stites et al. | 473/329 |
| 7,862,449 | B2 * | 1/2011 | Stites et al. | 473/329 |
| 2004/0038747 | A1 | 2/2004 | Lindsay | |
| 2005/0009623 | A1 | 1/2005 | Dickinson | |
| 2005/0130764 | A1 | 6/2005 | Frame | |
| 2009/0105008 | A1 | 4/2009 | Kuan et al. | |

FOREIGN PATENT DOCUMENTS

JP 2008000509 1/2008

OTHER PUBLICATIONS

Notice of Reasons for Rejection from JP Application No. 2011-533236 dated Sep. 10, 2012.

C-Groove—Development, Harold Swash Putting School of Excellence, (Aug. 26, 2008), http:www.haroldwashputting.co.uk/haroldswash_development.htm.

(Continued)

*Primary Examiner* — Sebastiano Passaniti
(74) *Attorney, Agent, or Firm* — Banner & Witcoff, Ltd.

(57) ABSTRACT

A golf club head (such as a putter head), has a face that includes a ball-contacting region. The ball-contacting region has an inset containing an elastically deformable material and at least one rigid element disposed within the elastically deformable material. When a golf ball is struck, the elastically deformable material compresses and the rigid element imparts overspin to the ball that causes it to roll more accurately.

26 Claims, 6 Drawing Sheets

(56) References Cited

OTHER PUBLICATIONS

Rife Two Bar Hybrid Putter Review, Putter Zone Golf, (Mar. 7, 2008), http://www.putterzone.com/2008/03/rife-twobar-hybrid-putter-review.html.

International Search Report issued in related PCT/US2009/060735 mailed May 7, 2010.

International Search Report and Written Opinion from PCT Application No. PCT/US2011/067765 mailed Jun. 29, 2012.

Office Action issued Apr. 27, 2013 for Chinese Application No. 200980147442.6.

* cited by examiner

GOLF CLUB FACE WITH SPIN STRIP

CROSS REFERENCE TO RELATED APPLICATION

This is a continuation-in-part application of U.S. application Ser. No. 12/775,718, filed May 7, 2010, now U.S. Pat. No. 7,862,449, which is a continuation of U.S. application Ser. No. 12/259,541, filed Oct. 28, 2008, now U.S. Pat. No. 7,713,139, the disclosure of which is hereby incorporated by reference.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years, both in the United States and across the world. The number of individuals participating in the game and the number of golf courses have increased steadily over recent years.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location") to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Like other golf clubs, putters also must make square contact with the golf ball, in the desired direction or path, in order to produce straight and true rolls in the desired direction. Even small deviation from squareness between the putter head and the golf ball at the point of contact can cause inaccuracy, particularly on longer putts. Accordingly, putter head features that can ensure that the club face is square to the ball at the point of contact tend to help the ball roll straighter, truer, and in the desired direction. Additionally, friction between the putter head and the ball at contact can impart spin to the ball, potentially affecting accuracy. Some putter heads have been designed to reduce friction between the club face and the ball to reduce spin.

The present device addresses the problems discussed above and other problems, and provides advantages and aspects not provided by prior ball striking devices of this type. A full discussion of the features and advantages of the present invention is deferred to the following detailed description, which proceeds with reference to the accompanying drawings.

SUMMARY

The following presents a general summary of aspects of the invention in order to provide a basic understanding of at least some of its aspects. This summary is not an extensive overview of the invention. It is not intended to identify key or critical elements of the invention or to delineate the scope of the invention. The following summary merely presents some concepts of the invention in a general form as a prelude to the more detailed description provided below.

In one aspect, a golf club head has a face that includes a ball-contacting region. The ball-contacting region has an inset containing an elastically deformable material and at least one rigid element within the elastically deformable material. When a golf ball is struck, the elastically deformable material compresses. As the elastically deformable material compresses, the rigid element(s) contact the ball and impart overspin, which helps the ball to roll more stably, potentially improving accuracy.

In another aspect, a golf club has a head as described above and a shaft engaged with the head.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
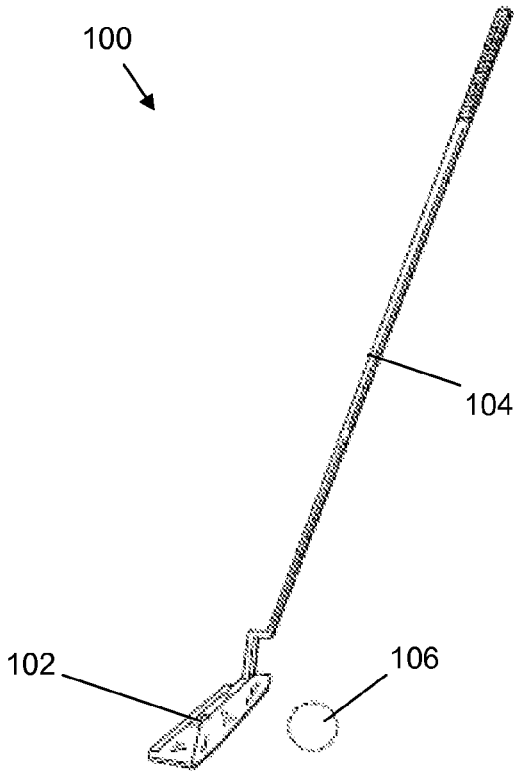
FIG. 1 is a perspective view of a golf club and a ball in use.

In the following description of various example embodiments, reference is made to the accompanying drawings, which form a part hereof, and in which are shown by way of illustration various example devices, systems, and environments in which aspects may be practiced. It is to be understood that other specific arrangements of parts, example devices, systems, and environments may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: Terms; General Description of Ball Striking Devices According to Aspects of the Invention; Specific Examples of the Invention; and Conclusion.

A. Terms

The following terms are used in this specification, and unless otherwise noted or clear from the context, these terms have the meanings provided below.

"Ball-contacting region" means the portion of a golf club face that includes and is located immediately adjacent (optionally surrounding) the portion of the golf club designed to contact the ball in use. In some examples, such as many golf clubs and putters, the ball striking region may be a separate and independent entity from any shaft or handle member, and it may be attached to the shaft or handle in some manner.

The terms "shaft" and "handle" are used synonymously and interchangeably in this specification, and they include the portion of a golf club that the user typically holds while swinging the club.

B. General Description of Golf Clubs

In general, golf club heads, golf clubs, putter heads, putters, and the like, typically include a head having a ball-contacting region that faces a ball in use. The golf club head may have a shaft engaged therewith.

The ball-contacting region typically has superior surface flatness. Generally, flatness is the degree to which a surface approximates a perfect mathematical plane. A ball-contacting region with better flatness provides less variation in the contact angle between the ball and the striking surface, creating more precise direction and/or trajectory of the ball when struck.

In general, a golf club may be manufactured by (a) forming a head having an inset region on a face surface thereof, (b) filling the inset region with an elastically deformable material and providing a plurality of rigid elements therein, and (c) connecting a shaft to the head. The rigid elements may be incorporated into the elastically deformable material either before or after the elastically deformable material is inserted into the inset region.

The head may be formed of one or more of a variety of materials, including metals, ceramics, polymers, composites, and wood, and may be formed in one of a variety of configurations. The head may be formed of a single piece or of multiple pieces, for example, by having a body with a face plate attached thereto, a body with separate weighting and/or balancing elements attached thereto, or a body formed of several pieces connected together. An inset may be machined or otherwise formed into the face of the head to receive elastically deformable material and rigid elements, as discussed more fully below. Machining may include, for example, one or more of such techniques as milling, lapping/grinding, turning/lathing, cutting, drilling, and focused ion beam (FIB) milling, and other mechanical and non-mechanical machining techniques.

C. Specific Examples

The various figures in this application illustrate examples of golf club heads and golf clubs useful in systems and methods according to examples of this invention. When the same reference number appears in more than one drawing, that reference number is used consistently in this specification and the drawings to refer to the same or similar parts throughout.

At least some example embodiments of golf clubs as described herein relate to putters. Such devices may include a one-piece construction or a multiple-piece construction. An example structure of a golf club will be described in detail below in conjunction with FIGS. 1-4, and referred to generally using reference numeral "100."

FIG. 1 illustrates an example of a golf club 100 in the form of a putter. The golf club 100 includes a head 102 and a shaft 104 connected to the head 102 and extending therefrom. A ball 106 in use is also schematically shown in FIG. 1, in a position to be struck by the golf club 100.

Figure 2:
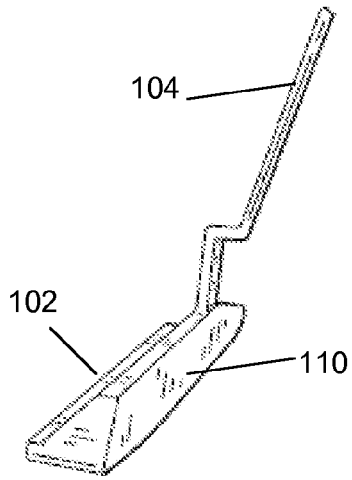
FIG. 2 is a perspective view of a head of the golf club of FIG. 1.
Figure 3:
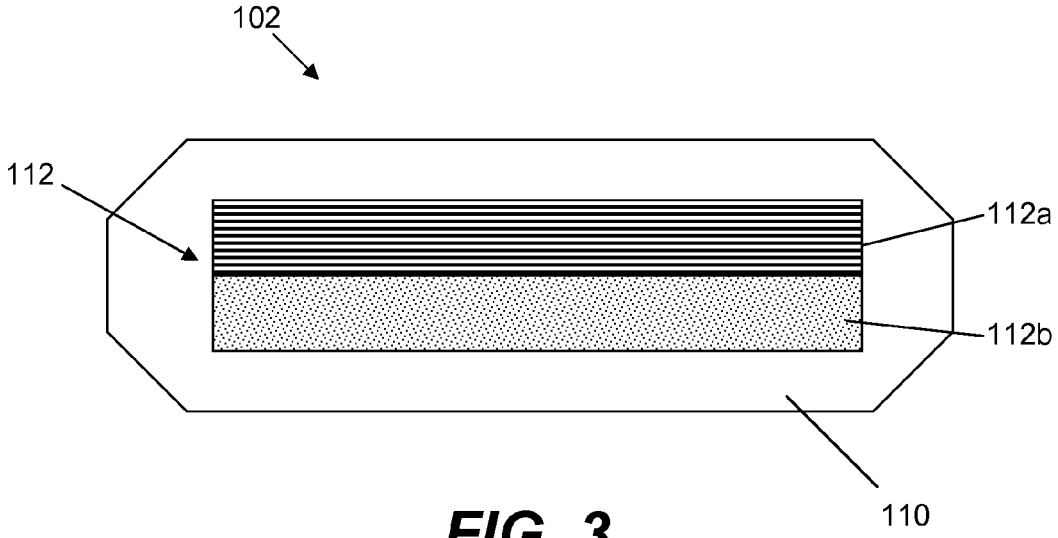
FIG. 3 is a front view of a golf club head having an inset containing elastically deformable material and rigid elements.
Figure 4:
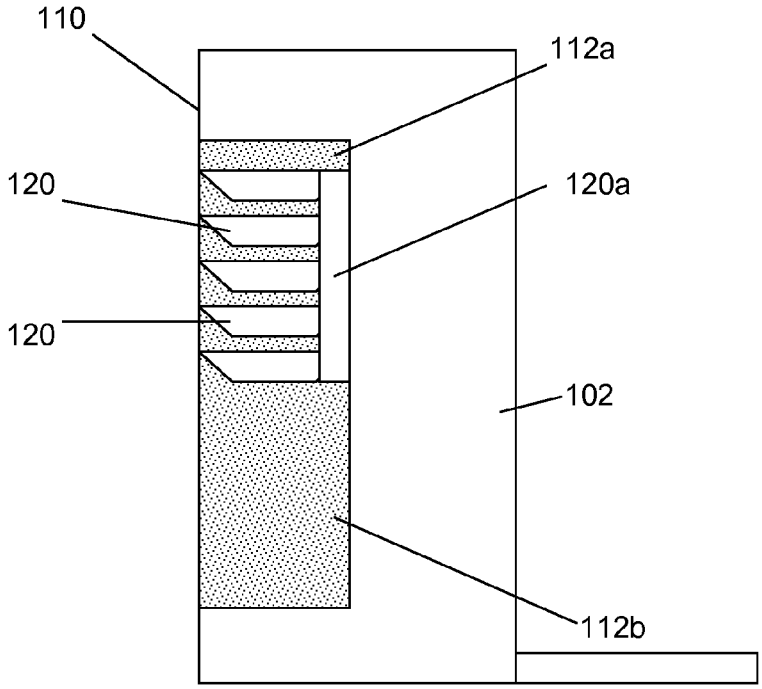
FIG. 4 is a cross-sectional view of the golf club head of FIG. 3.

The head 102 of the golf 100 is shown in greater detail in FIGS. 2-4. In the embodiment shown in FIGS. 1-4, the head 102 is of a one-piece, unitary construction. The ball striking head 102 has a body with a ball-contacting region 110 that faces the ball 106 in normal use, and is adapted to strike the ball 106 when the golf club 100 is set in motion, such as by swinging. As shown, the ball-contacting region 110 is flat and relatively planar, occupying an entire face of the head 102. In the putter shown in FIGS. 1-4, the head 102 and the ball-contacting region 110 are significantly elongated horizontally. In other applications, such as for a different type of golf club, the head may be designed to have different dimensions, with a differently sized ball-contacting region.

In other embodiments, the head 102 may be of a multi-piece construction. For example, in one embodiment, the head 102 may have a single-piece body with a separate piece added to comprise all or part of the ball-contacting region 110. In another embodiment, the head 102 may have a multi-piece body. In a further embodiment, the body may have additional pieces attached thereto, such as elements for weighting, balancing, or affecting the "feel" or response of the head 102. Still further embodiments are contemplated without departing from the scope of the invention.

The golf club 100 may include a shaft 104 connected to or otherwise engaged with the ball striking head 102. The shaft 104 is adapted to be gripped by a user to swing the golf club 100 at the ball 106. The shaft 104 can be formed as a separate piece connected to the head 102, such as by being received in a hole or recess in the head 102. In other embodiments, at least a portion of the shaft may be an integral piece with the head 102. Still further embodiments are contemplated without departing from the scope of the invention.

The head 102 and shaft 104 may be constructed from one or more of a variety of materials, including metals, ceramics, polymers, composites, or wood. In the case of a golf putter, the head 102 may typically be constructed of a metal or metallic composite and the shaft 104 may typically be constructed of a metal or a metallic or polymeric composite (such as a carbon fiber composite). However, it is contemplated that the head 102 and/or the shaft 104 may be constructed of different materials. Additionally, the head 102 and/or the shaft 104 may have multiple pieces constructed of different materials. For example, the head 102 may have a face plate defining the ball-contacting region 110 or a weight made of a heavier metal than the bulk of the head 102.

With reference to FIG. 3, the ball-contacting region 110 has an inset 112 containing an elastically deformable material. A variety of materials may be used for the elastically deformable material, such as naturally occurring and/or synthetic materials, including thermoplastic and thermoset materials, non-limiting examples of which include thermoplastic elastomers ("TPE"), thermoplastic olefins ("TPO"), soft thermoplastic polyolefin, or other elastomeric material such as ethylene-vinylacetate copolymer or ethylene propylene rubber. In general, the elastically deformable material has a hardness that enables the material to compress to some extent when a golf ball is struck under intended conditions, such as putting. The hardness of the elastically deformable material usually is greater than typical golf ball cover hardness, which typically ranges from about 50 to about 65 Shore D.

A plurality of rigid elements 120 is disposed within the elastically deformable material. The rigid elements 120 may be located throughout the inset 112 or, as shown in FIGS. 3 and 4, the rigid elements 120 may be positioned in a portion of the inset 112, such as the upper portion 112*a*. For example, rigid elements 120 may be positioned at 0.25" and 1.0" above the leading edge (bottom) of the golf club head 102. A lower portion 112*b* of the inset 112 may contain only the elastically deformable material. This way, when a golf ball is struck, the elastically deformable material compresses, causing the rigid elements 120 in the upper portion 112*a* to contact or otherwise impart a reactive force to the golf ball above its center, creating overspin that helps the ball to roll more accurately.

The rigid elements 120 may be constructed of a metal, such as steel, or other rigid material such as a sturdy plastic. In general, the rigid elements have a hardness significantly greater than that of the elastically deformable material. The rigid elements 120 should have a sharp edge at the surface of the elastically deformable material. This way, the rigid elements 120 provide a "cutting edge" when a golf ball is pressed onto the ball-contacting region 110.

As shown in FIG. 4, the rigid elements 120 may be in the form of blades, each of which may be shaped as an elongated polygon, such as a trapezoid. The first ends of the blades 120 proximate the ball-contacting region 110 may be angled with respect to the plane of the ball-contacting region 110. For example, the first ends of the blades 120 may be angled at an angle of from about 30 to about 60 degrees, often from about 35 to about 55 degrees, with respect to the plane of the ball-contacting region 110. The angled first ends of the blades 120 may increase the amount of surface contact between the blades 120 and a golf ball when the golf ball is struck above its center axis.

The rigid elements 120 may be provided as discrete elements embedded in the elastically deformable material. Alternatively, the rigid elements 120 may together comprise an integral member 120*a* that is inserted into the inset 112, as shown in FIG. 4. Yet another alternative is to form the rigid elements integrally with the head 102. For example, grooves may be machined or otherwise formed in the head 102 to form the inset 112 into which the elastically deformable material is inserted.

Figure 5:
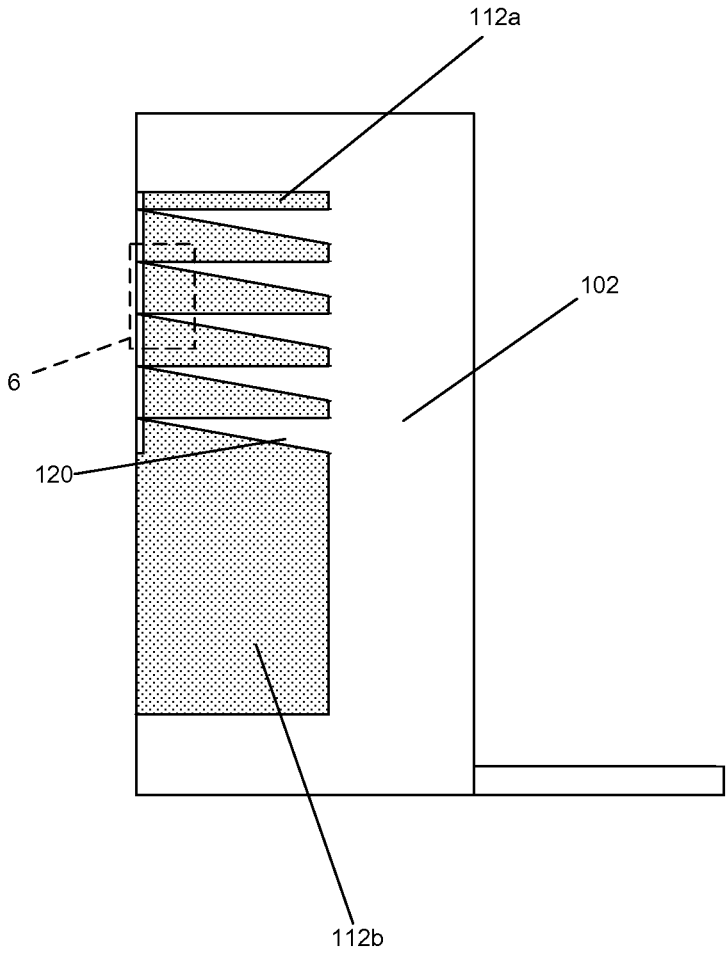
FIG. 5 is a cross-sectional view of another embodiment of a golf club head according to aspects of the disclosure.

FIG. 5 is an illustrative example of an embodiment of the disclosure wherein the head 102 includes rigid elements 120 that are formed integrally with the head 102. As seen in FIG. 5, the rigid elements 120 are integral with the head 102 and defined, at least in part, between grooves or gaps in the head 102. In the embodiment shown in FIG. 5, and, as discussed above, according to aspects of the disclosure, the head 102 may be machined in order to provide the rigid elements 120 that are integral with the head 102. For example, the rigid elements 120 may be formed by extruding material from the head 102 in order to provide the grooves or gaps in the head 102 which define, at least in part, the rigid elements 120.

Forming the rigid elements 120 by machining the head 102, such as described above, allows the configuration and the dimensions of the rigid elements 120 (and the head 102 in general) to be strictly controlled. For example, the shape of the rigid elements 120, the angle(s) of the rigid elements 120, the length and thickness of the rigid elements 120, the size of the grooves between the rigid elements 120, etc., can be manufactured precisely in order to provide accurate dimensions for the various elements of the head 102. For example, as seen in the embodiment depicted in FIG. 5, the rigid elements 120 are configured with a triangular shape and the angle at the end of the triangular rigid elements 120 may be precisely configured as desired. For example, according to particular embodiments of the disclosure, the angle at the end of the rigid elements 120 may be configured to be 30° (of course other angles may be provided as desired depending on the embodiment of the head 102).

It is noted that while the process of machining the head 102 in order to provide integral rigid elements 120 is one method of creating the head 102, according to other aspects of the disclosure, the integral rigid elements 120 may be provided by other methods as well. For example, the head 102 (including the rigid elements 120) may be formed by molding, casting, etc.

According to particular aspects of the disclosure, in embodiments wherein the rigid elements 120 are provided integrally with the head 102, the head 102 may be filled with the elastically deformable material. For example, the elastically deformable material may be inserted into the front of the head 102 (e.g., inserted in the inset 112). As discussed above, the elastically deformable material may be naturally occurring and/or synthetic materials, including thermoplastic and thermoset materials, or other elastomeric material. According to aspects of the disclosure, the elastically deformable material may be inserted when the elastically deformable material is in a first state (e.g., a fluid state) and, thereafter, becomes a second state (e.g., a more rigid state than the first state). However, other methods of inserting the elastically deformable material into the head 102 may be used as well (e.g., the elastically deformable material may be inserted and retained in the head 102 in a single state).

Figure 6:
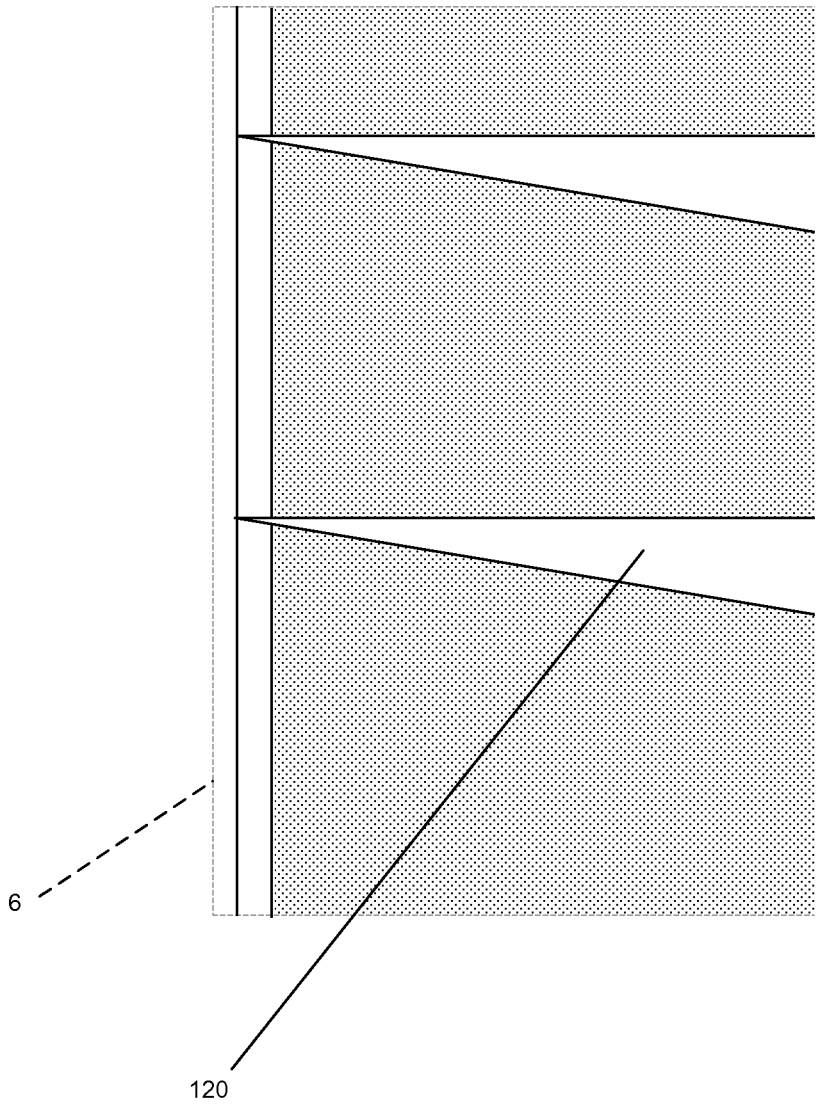
FIG. 6 is an enlarged view of a portion of the cross-sectional view of the embodiment shown in FIG. 5.
Figure 7:
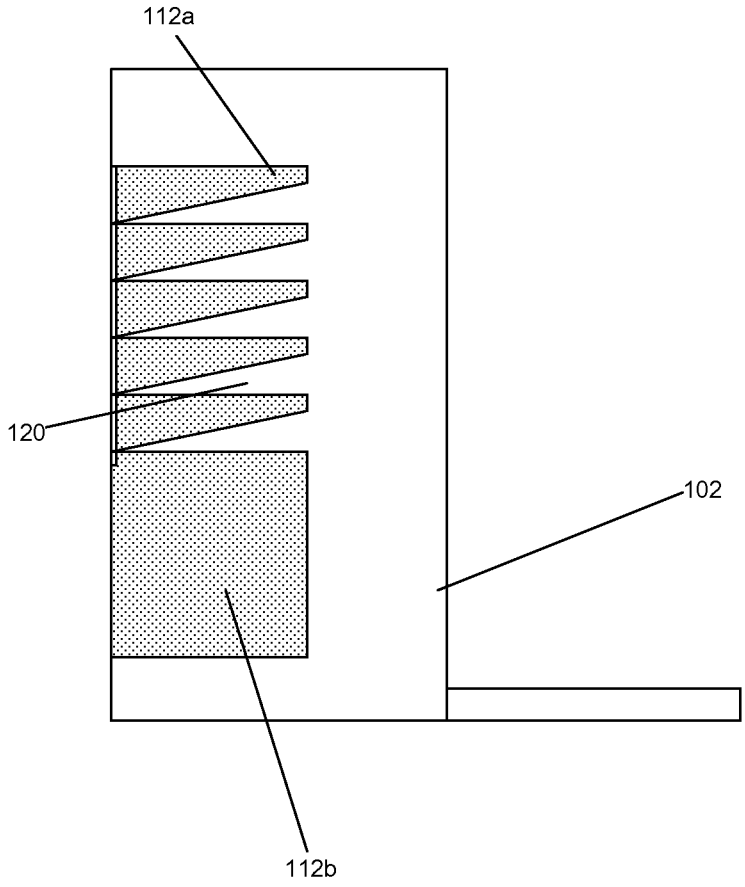
FIG. 7 is a cross-sectional view of another embodiment of a golf club head according to aspects of the disclosure.

According to aspects of the disclosure, the rigid elements 120 may protrude beyond the elastically deformable material. For example, as seen in the embodiment shown in FIG. 5, the ends, or edge portions, of the rigid elements 120 extend beyond a surface of the elastically deformable material that faces the ball during contact with the ball (e.g., during a putting stroke). FIG. 6 provides an enlarged view of a portion of the embodiment shown in FIG. 5, wherein the extension of the rigid elements 120 beyond the surface of the elastically deformable material may be seen more clearly. By configuring the head 102 so that the ends of the rigid elements 120 protrude beyond the surface of the elastically deformable material, the ends of the rigid elements 120 may contact the golf ball during a golf swing, such as during a putting stroke, in order to provide the enhanced control features discussed above. It is noted that the configuration of the rigid elements 120 (e.g., the length, the angle at the end of a rigid element, etc.) may be configured in order to provide optimum control during the golf stroke. For example, the rigid elements 120 may be configured to protrude any desired distance and be configured to exhibit any desired angle to provide optimum control during the golf stroke. According to some aspects of the disclosure, if desired, the rigid elements 120 may be configured with an inverted orientation relative to the rigid elements 120 shown in FIG. 5, (e.g., the rigid elements 120 may be configured such that the angled surfaces face upwards, as seen in FIG. 7).

Figure 8:
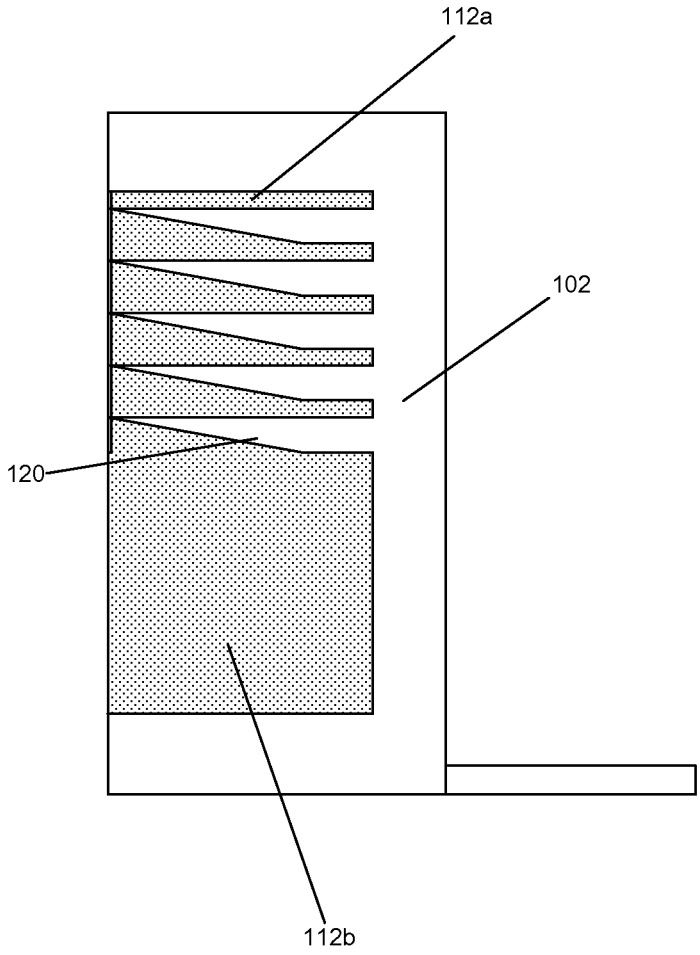
FIG. 8 is a cross-sectional view of another embodiment of a golf club head according to aspects of the disclosure.

It is noted that according to aspects of the disclosure, the inset 112 may be configured to contain a larger percentage of elastically deformable material (e.g., as compared with other embodiments of the disclosure). For example, the inset 112 may include recesses configured to be filled with elastically deformable material. For example, FIG. 8 is an illustrative embodiment of the disclosure wherein the head 102 contain a larger percentage of elastically deformable material (e.g., as compared with other embodiments of the disclosure). If desired, the recesses may be made larger than the illustrative embodiment shown in FIG. 8 in order to hold additional elastically deformable material (e.g., the recesses may be extended further back toward the rear of the head 102 or enlarged in the height direction).

According to aspects of the disclosure, configuring the head 102 so that the ends of the rigid elements 120 protrude beyond the elastically deformable material may be accomplished in a variety of ways. For example, as discussed above, according to particular aspects of the disclosure, the head 102 may be configured with rigid elements 120 that are integral with the head 102 (e.g., by performing a machining process, such as described above, on the head 102). Further, the elastically deformable material may be inserted into the head 102 (e.g., inserted into the inset 112 in a process, such as described above). Additionally, according to aspects of the disclosure, portions of the elastically deformable material around the individual rigid elements 120 may be removed in order to expose portions of the rigid elements 120 (e.g., the ends, or edge portions, of the rigid elements 120). For example, the portions of the elastically deformable material that are located between the rigid elements 120 may be removed. According to aspects of the disclosure, the elastically deformable material may be polished to remove portions of the elastically deformable material (e.g., excess elastically deformable material) around the individual rigid elements 120 in order to expose the ends of the rigid elements 120. It is noted that the elastically deformable material may be removed at other areas of the inset 112 and removed via other methods as well. Further, the ends of rigid elements 120 may be polished as well.

It is noted that configuring the head 102 so that portions of the rigid elements 120, such as the ends of the rigid elements 120, protrude beyond the elastically deformable material may be accomplished by other methods as well. For example, according to particular embodiments of the disclosure, prior to insertion in the head 102, the rigid elements 120 may be provided as discrete elements (or a single element of a plurality of connected rigid elements 120) and embedded in the elastically deformable material. Thereafter, the rigid elements 120 embedded in the elastically deformable material may be inserted into and secured within the inset 112 of the head 102. Further, it is noted that the process of removing the elastically deformable material in order to expose the ends of the rigid elements 120 may be done prior to, or subsequent to, the insertion in the inset 112. Alternatively, the embedding of the rigid elements 120 in the elastically deformable material may be done such that the ends of the rigid elements 120 already protrude through the elastically deformable material without having to remove the portions of the elastically deformable material.

D. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising a body and a face having a ball-contacting region, wherein the ball-contacting region comprises an inset containing an elastically deformable material having a surface, and at least one rigid element connected to the body within the inset and extending through the elastically deformable material such that an edge portion of the at least one rigid element extends beyond the surface of the elastically deformable material, wherein the inset containing the elastically deformable material has an upper portion and a lower portion, wherein the at least one rigid element is disposed only in the upper portion of the inset.

2. The golf club head of claim 1 wherein the elastically deformable material comprises a polymeric material.

3. The golf club head of claim 2 wherein the polymeric material is selected from the group consisting of thermoplastic elastomers, thermoplastic olefins, soft thermoplastic polyolefin, ethylene-vinylacetate copolymer, ethylene propylene rubber, and combinations thereof.

4. The golf club head of claim 1 wherein the at least one rigid element comprises a plurality of blades.

5. The golf club head of claim 4 wherein the blades are shaped as elongated polygons.

6. The golf club head of claim 4 wherein the blades are shaped as triangles.

7. The golf club head of claim 6 wherein each of the blades has a first end which is angled with respect to the face.

8. The golf club head of claim 7 wherein the blades are angled at an angle of from about 30 to about 60 degrees with respect to the face.

9. The golf club of claim 1, wherein the at least one rigid element is integrally formed with the body.

10. The golf club of claim 1, wherein the at least one rigid element is shaped as an elongated triangle.

11. The golf club of claim 1, wherein the edge portion of the at least one rigid element is angled with respect to the surface of the elastically deformable material.

12. The golf club of claim 1, wherein the face includes an opening, wherein the inset is located in the opening, and wherein the at least one rigid element is connected to a back surface of the opening.

13. A golf club having an elongate shaft and a head positioned on an end of the shaft, the head comprising:

a body and a face having a ball-contacting region, wherein the ball-contacting region comprises an inset containing an elastically deformable material having a surface, and at least one rigid element connected to the body within the inset and extending through the elastically deformable material such that an edge portion of the at least one rigid element extends beyond the surface of the elastically deformable material, wherein the inset containing the elastically deformable material has an upper portion and a lower portion, and wherein the lower portion contains a higher proportion of the elastically deformable material than the upper portion.

14. The golf club of claim 13 wherein the elastically deformable material comprises a polymeric material.

15. The golf club of claim 13 wherein the polymeric material is selected from the group consisting of thermoplastic elastomers, thermoplastic olefins, soft thermoplastic polyolefin, ethylene-vinylacetate copolymer, ethylene propylene rubber, and combinations thereof.

16. The golf club of claim 13 wherein the at least one rigid element comprises a plurality of blades.

17. The golf club of claim 16 wherein the blades are shaped as elongated polygons.

18. The golf club of claim 16 wherein the blades are shaped as triangles.

19. The golf club of claim 16 wherein each of the blades has a first end which is angled with respect to the face.

20. The golf club of claim 16 wherein the blades are angled at an angle of from about 30 to about 60 degrees with respect to the face.

21. The golf club of claim 16 wherein the at least one rigid element is disposed only in the upper portion of the inset.

22. A method of forming a golf club head comprising:

providing a golf club head including a body and a face having a ball-contacting region, wherein the ball-contacting region comprises an inset which contains at least one rigid element; providing an elastically deformable material in the inset and such that at least one rigid element is connected to the body within the inset and extending through the elastically deformable material, wherein the inset containing the elastically deformable material has an upper portion and a lower portion, wherein the at least one rigid element is disposed only in the upper portion of the inset, wherein the elastically deformable material has a surface; and configuring an edge portion of the at least one rigid element to extend beyond the surface of the elastically deformable material.

23. The method of forming a golf club head according to claim 22, wherein the at least one rigid element is formed integrally with the golf club head.

24. The method of forming a golf club head according to claim 23, wherein the golf club head is machined in order to provide at least one rigid element.

25. The method of forming a golf club head according to claim 22, wherein configuring an edge portion of the at least one rigid element to extend beyond the surface of the elastically deformable material includes removing at least a portion of the elastically deformable material.

26. The method of forming a golf club head according to claim 25, wherein removing at least a portion of the elastically deformable material includes polishing the elastically deformable material in order to expose the edge portion of the at least one rigid element.

* * * * *